US008320710B2

(12) United States Patent
Pinault

(10) Patent No.: US 8,320,710 B2
(45) Date of Patent: Nov. 27, 2012

(54) DEVICE FOR DETERMINING THE POSITION AND/OR THE TRANSVERSE DIMENSION OF A DRILL HOLE IN A PRESENTATION LENS FOR RIMLESS EYEGLASSES

(75) Inventor: Philippe Pinault, Charenton le Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 833 days.

(21) Appl. No.: 12/519,644

(22) PCT Filed: Dec. 19, 2007

(86) PCT No.: PCT/FR2007/002110

§ 371 (c)(1),
(2), (4) Date: Jun. 17, 2009

(87) PCT Pub. No.: WO2008/093015

PCT Pub. Date: Aug. 7, 2008

(65) Prior Publication Data

US 2010/0092068 A1 Apr. 15, 2010

(30) Foreign Application Priority Data

Dec. 20, 2006 (FR) ..... 06 11124

(51) Int. Cl.

| | |
|---|---|
| ***G06K 9/36*** | (2006.01) |
| ***G06K 9/18*** | (2006.01) |
| ***G06K 9/00*** | (2006.01) |
| ***G02C 5/00*** | (2006.01) |
| ***G02C 1/02*** | (2006.01) |

(52) U.S. Cl. ..... 382/291; 382/186; 382/141; 382/152; 351/41; 351/110

(58) Field of Classification Search ..... None
See application file for complete search history.

(56) References Cited

U.S. PATENT DOCUMENTS

| | | | | |
|---|---|---|---|---|
| 6,170,950 | B1 * | 1/2001 | Yoshida | 351/110 |
| 6,210,002 | B1 * | 4/2001 | Tachibana | 351/110 |
| 6,312,126 | B1 * | 11/2001 | Yoshida | 351/110 |
| 6,523,952 | B1 * | 2/2003 | Krumme | 351/110 |

(Continued)

FOREIGN PATENT DOCUMENTS

| | | |
|---|---|---|
| EP | 1 053 075 | 9/2002 |

(Continued)

OTHER PUBLICATIONS

International Search Report dated Jul. 14, 2008, from corresponding PCT.

*Primary Examiner* — Michelle Entezari
(74) *Attorney, Agent, or Firm* — Young & Thompson

(57) ABSTRACT

The device includes: bearing element (55) for the lens (100); element (53) for acquiring a global image (90) of the drill hole (110) of the lens (100) in a lighting direction (D51, A52), or image acquisition direction (A53); element (54) for processing the image when the lens is carried by the carrier element (55). The processing element (54) designed for determining, from the global image of the drill hole (110) the position of center (C1) of the opening of the drill hole (110) that gives onto one of the faces (98) of the lens (100) and/or the transverse dimension of the opening of the drill hole (110) that corresponds to the desired transverse dimension (D).

19 Claims, 4 Drawing Sheets

U.S. PATENT DOCUMENTS

| | | | | |
|---|---|---|---|---|
| 6,785,585 | B1 * | 8/2004 | Gottschald | 700/159 |
| 7,320,516 | B2 * | 1/2008 | Kroman et al. | 351/178 |
| 7,611,243 | B2 * | 11/2009 | Takeichi | 351/178 |
| 2006/0178086 | A1 * | 8/2006 | Shibata | 451/6 |
| 2006/0286902 | A1 * | 12/2006 | Covarrubias et al. | 451/5 |
| 2008/0051012 | A1 * | 2/2008 | Akiyama et al. | 451/42 |

FOREIGN PATENT DOCUMENTS

| | | |
|---|---|---|
| EP | 1 676 683 | 7/2006 |
| EP | 1 679 153 | 7/2006 |
| FR | 2 865 046 | 7/2005 |

* cited by examiner 51
52
D51
D51
D51
A52
II
E
98
100
110
99
55
50
A53
Y
X
53
54

DEVICE FOR DETERMINING THE POSITION AND/OR THE TRANSVERSE DIMENSION OF A DRILL HOLE IN A PRESENTATION LENS FOR RIMLESS EYEGLASSES

TECHNICAL FIELD OF THE INVENTION

The present invention relates in a general manner to mounting ophthalmic lenses of a pair of eyeglasses in a rimless type frame, and more particularly it relates to a device for determining the position and/or the transverse dimension of a drill hole of a presentation lens (that is used as a model) with a view to drilling, at said position and/or said transverse dimension, an unmounted lens that is to be assembled with a rimless eyeglass frame.

TECHNOLOGICAL BACKGROUND

When an eyeglass frame is of the rimless type, the shaping of each of the corrective lenses intended to be joined to the frame is followed by drilling each lens appropriately so as to enable the temples and the nose bridge of the rimless frame to be fastened thereon. The drilling may be performed with an edger or with a separate drilling machine by means of a drill bit.

Most often, the following drilling method is implemented. First, the future wearer chooses the desired frame provided with presentation lenses. The optician then places the presentation lenses one after the other into a device for determining the positions of the drill holes. Each presentation lens is pre-drilled in its temporal and nasal portions and thus serves as a model for appropriately shaping and drilling the target corrective lens that is to be joined to the frame chosen by the future wearer.

The presentation lens is thus placed in a support between lighting means for producing a projected view and image capture means, with the front face of the lens facing towards the lighting means. A plate made out of frosted glass allows a projected image of the shadow of the lens to be formed on the capture means.

The image of the shadow of the presentation lens is acquired. Thus an overall image of the drill hole is obtained that presents a geometrical shape that is complex. This overall image is displayed on a screen. A virtual identification-marking ring is provided that the operator can view and move around the screen so as to superpose the ring onto the overall image of the drill hole of the presentation lens, while also sizing and centering the ring. The operator validates the positioning and the sizing, and the processor system stores the position of the center and the transverse dimension (i.e. its diameter if the hole is round) of the identification-marking ring as being the position of the center and the transverse dimension of the drill hole to be drilled in the corrective lens.

After the corrective lens has been shaped to match the outline of the presentation lens, a drill bit having an appropriate diameter is brought to face the corrective lens at the stored position for the hole to be drilled. The corrective lens is thus drilled by means of the drill bit being free to move relative to the lens along the axis of rotation of the drill bit. If the diameter of the drill bit is less than the desired diameter, the resulting hole is widened by imparting an appropriate transverse movement to the drill bit.

However, in particular for lenses that are greatly curved, it is observed that an often significant error exists between the position of the drill hole drilled in the corrective lens and the real position and dimension of the drill hole in the presentation lens. This error in the positioning and the dimension of the hole leads to difficulties in mounting the lens onto the temples and the nose bridge and may even, in some circumstances, end up with mounting being impossible or of poor quality, or may even oblige the optician to perform a reworking operation that is time consuming and that requires expert knowledge. Further, the corrective lens may, as a result, be poorly positioned in front of the eye of the wearer, thereby degrading its performance in optical correction.

OBJECT OF THE INVENTION

The aim of the present invention is to determine precisely the position and/or a transverse dimension of a drill hole to be drilled in the lens to be assembled to a eyeglass frame of the rimless type.

To this end, the invention proposes a device for precisely determining the position and/or a transverse dimension of a drill hole of a presentation lens for rimless eyeglasses, the device comprising:

- support means for supporting the lens;
- capture means for capturing an overall image of the drill hole of the lens in a lighting or image capture direction; and
- processor means for processing said image when the lens is carried by the device support means;

in which device the processor means are suitable for using the overall image of the drill hole to determine the position of center of the orifice of the drill hole opening into one of the faces of the lens, and/or to determine the transverse dimension of the orifice of the drill hole corresponding to the looked-for transverse dimension.

When the corrective lens is being drilled, e.g. from the front face of the lens, the drill bit drills the corrective lens at a point on the face of the lens that becomes the center of the front orifice of the drill hole being drilled. In the state of the art, the drill bit is brought up to the front face of the lens at the position associated with the center of the overall image of the drill hole of the presentation lens, which position corresponds generally to the position of center of the overall image of the drill hole of the presentation lens as projected onto a plane perpendicular to the lighting or image capture direction.

As a result of the curvature of the presentation lens, the axis of the drill hole in said lens is inclined relative to the image capture direction, such that, seen in the lighting or image capture direction, there exist:

- firstly, an offset between the center of the projected volume of the drill hole and the center of the orifice in the front or back face of the drill hole and;
- secondly, a difference between the transverse dimension of the drill hole (i.e. the transverse dimension of its orifices) in the presentation lens and the transverse dimension of the overall image of the drill hole acquired in the lighting or image capture direction.

An initial error is therefore produced in the very acquisition of the position or dimension of the drill hole. This explains how the position and the transverse dimension of the drill hole obtained on the drilled corrective lens are found to be incorrect in practice.

As a result of the device in the invention, the acquired overall image is used to calculate the position of center of the orifice of the drill hole opening into one of the faces of the lens, e.g. the front face, and also to calculate its transverse dimension, thereby enabling the drill bit to be positioned correctly facing the determined position for the center of the orifice in the front face and/or to dimension and control the drill bit so as to obtain a hole with a transverse dimension that corresponds precisely to the transverse dimension of the hole in the presentation lens. The drill hole obtained in the corrective lens is thus correctly positioned and/or dimensioned.

In a first embodiment of the invention, the processor means comprise:

means for acquiring the position of center of the overall image of the drill hole; and first correction means suitable for calculating the position of center of the orifice of the drill hole in said face, using the position of center of the overall image and data representative of the angle of inclination of the drill hole formed between the lighting or image capture direction and the axis of the drill hole.

Then, and advantageously, for the overall image comprising first and second image rings that are formed on the capture means by the images of the orifices of the drill hole and that are superposed in part one upon the other, said acquisition means comprise:

means for generating an identification-marking ring;

means for superposing said identification-marking ring onto the overall image;

means for storing the position of center of said identification-marking ring; and means for associating the stored position of center of said identification-marking ring with the position of center of the overall image of the drill hole.

In another aspect of the first embodiment of the invention, the processor means comprise:

means for acquiring the transverse dimension of the acquired overall image of the drill hole; and first correction means suitable for calculating the transverse dimension of the orifice of the drill hole in said face, using the transverse dimension of the overall image and data representative of the angle of inclination of the drill hole formed between the lighting or image capture direction and the axis of the drill hole.

Then, and advantageously, for the overall image comprising first and second image rings that are formed on the capture means by the images of the orifices of the drill hole and that are superposed in part one upon the other, said acquisition means comprise:

means for generating a identification-marking ring;

means for superposing and sizing said identification-marking ring on the overall image;

means for storing the transverse dimension of said identification-marking ring; and means for associating the stored transverse dimension of said identification-marking ring with the transverse dimension of the overall image of the drill hole.

According to another advantageous characteristic, said first correction means also operate as a function of the refractive index and/or of the thickness of the presentation lens. This makes it possible to correct the image acquisition errors that result from prismatic deflections generated by the presentation lens on its own image.

In a second embodiment of the invention, for the overall image comprising first and second image rings that are formed on the capture means by the images of the orifices of the drill hole and that are superposed in part one upon the other, the processor means comprise:

means for acquiring the center of the image ring formed by the image of the orifice of the drill hole opening into said face; and means for defining, with or without correction, the position of center of the orifice of the drill hole opening into said face, as a function of the position of said center of the image ring.

Then, and advantageously, said means for defining the position of center of the orifice of the drill hole opening into said face calculate a first correction as a function of the refractive index and/or the thickness of the presentation lens. This enables the image acquisition errors that result from prismatic deflections generated by the presentation lens onto its own image to be corrected.

In another aspect of this second embodiment of the invention, for the overall image comprising first and second image rings that are formed on the capture means by the images of the orifices of the drill hole and that are superposed one upon the other, the processor means comprise:

means for acquiring the transverse dimension of the image ring formed by the image of the orifice of the drill hole opening into said face; and first correction means suitable for using the transverse dimension of said image ring and data representative of the angle of inclination of the drill hole formed between the lighting direction or the image capture direction and the axis of the drill hole to calculate the transverse dimension of the orifice of the drill hole opening into said face.

Then, and advantageously, said first correction means also operate as a function of the refractive index and/or of the thickness of the presentation lens. This makes it possible to correct the image acquisition errors that result from prismatic deflections generated by the presentation lens on its own image.

According to another advantageous characteristic of the invention, applicable to all the above-defined embodiments, the processor means are suitable for using the overall image of the drill hole to determine the relative distance in projection between the center of said orifice of the drill hole in the presentation lens and the edge of the presentation lens, in projection along said lighting or image capture direction in an acquisition plane that is substantially perpendicular to said lighting or image capture direction.

Then, and advantageously, the processor means include second correction means that are suitable for using the relative distance in projection and data representative of the angle of inclination of the drill hole formed between the lighting or image capture direction and the axis of the drill hole, to calculate a real relative distance between the center of said orifice and the edge of the presentation lens, considered in the plane perpendicular to the axis of the drill hole.

DETAILED DESCRIPTION OF AN EMBODIMENT

The description below, with reference to the accompanying drawings, given by way of non-limiting example, makes it well understood what the invention consists in, and how it can be reduced to practice.

In the accompanying drawings

Figure 7:
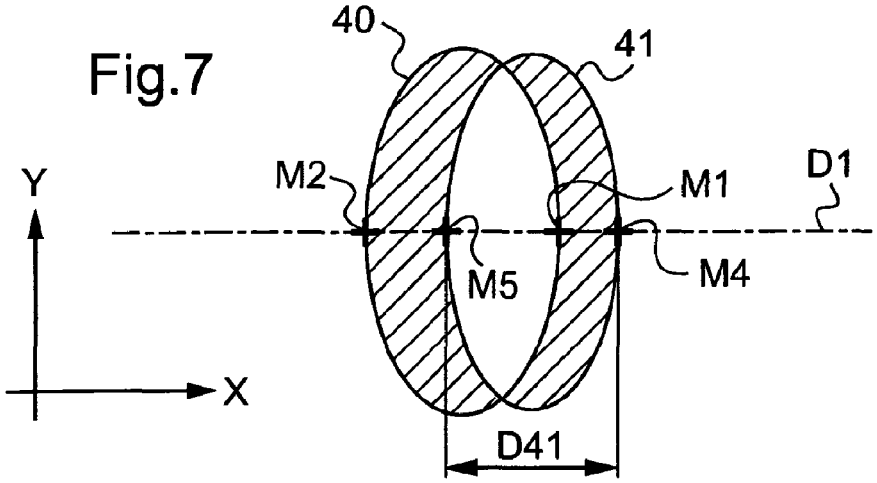
Figure 6:
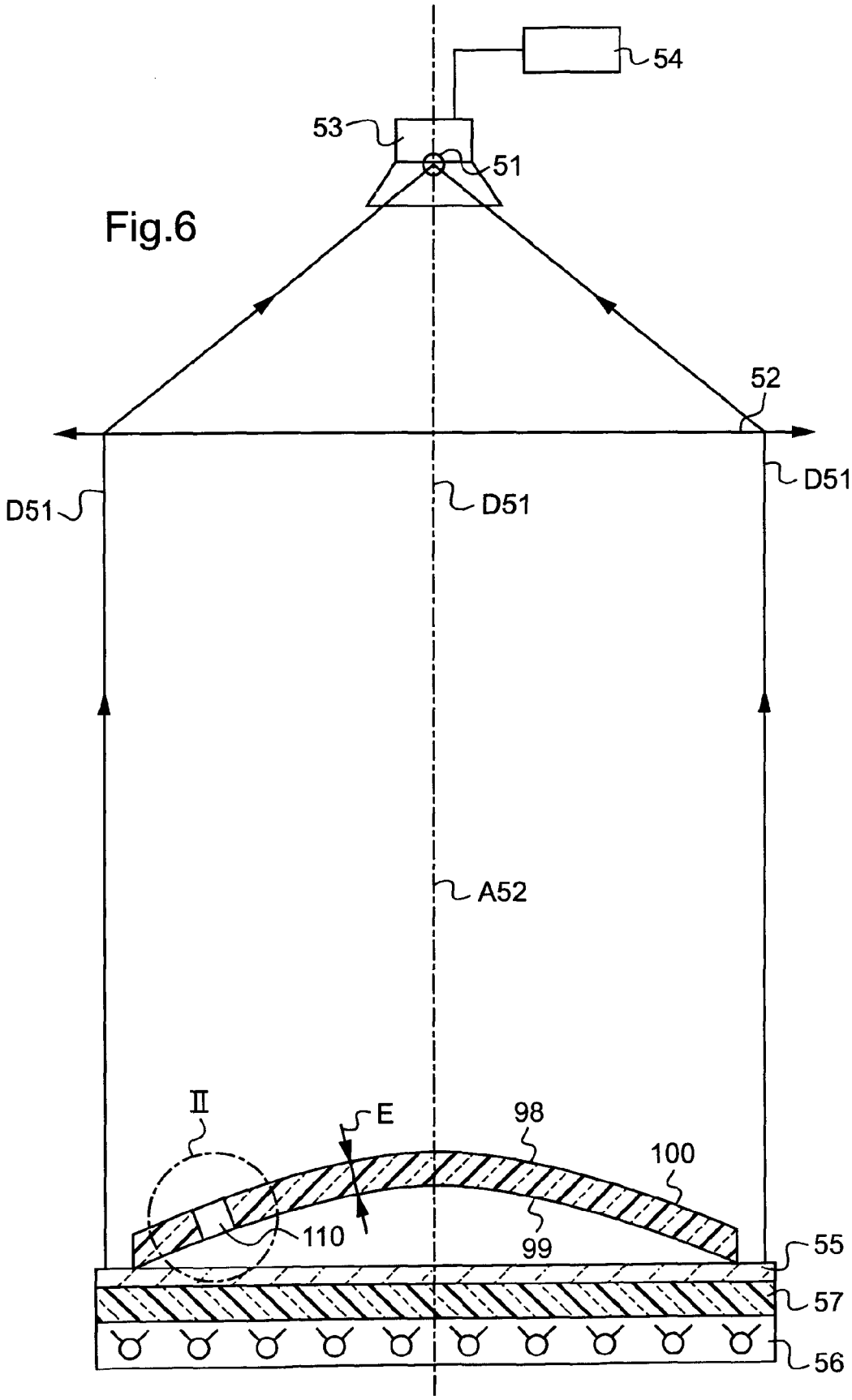

FIG. 6 is a diagrammatic view in axial section of an acquisition device for acquiring the position of the drill holes of a presentation eyeglass lens in a second embodiment of the invention; and FIG. 7 is a view showing, in a transverse plane, the overall image of the drill hole of the presentation lens of FIG. 6 sensed by the acquisition means of the device of FIG. 6, some of the points of the image being used for calculating the position of the drill hole.

Figure 1:
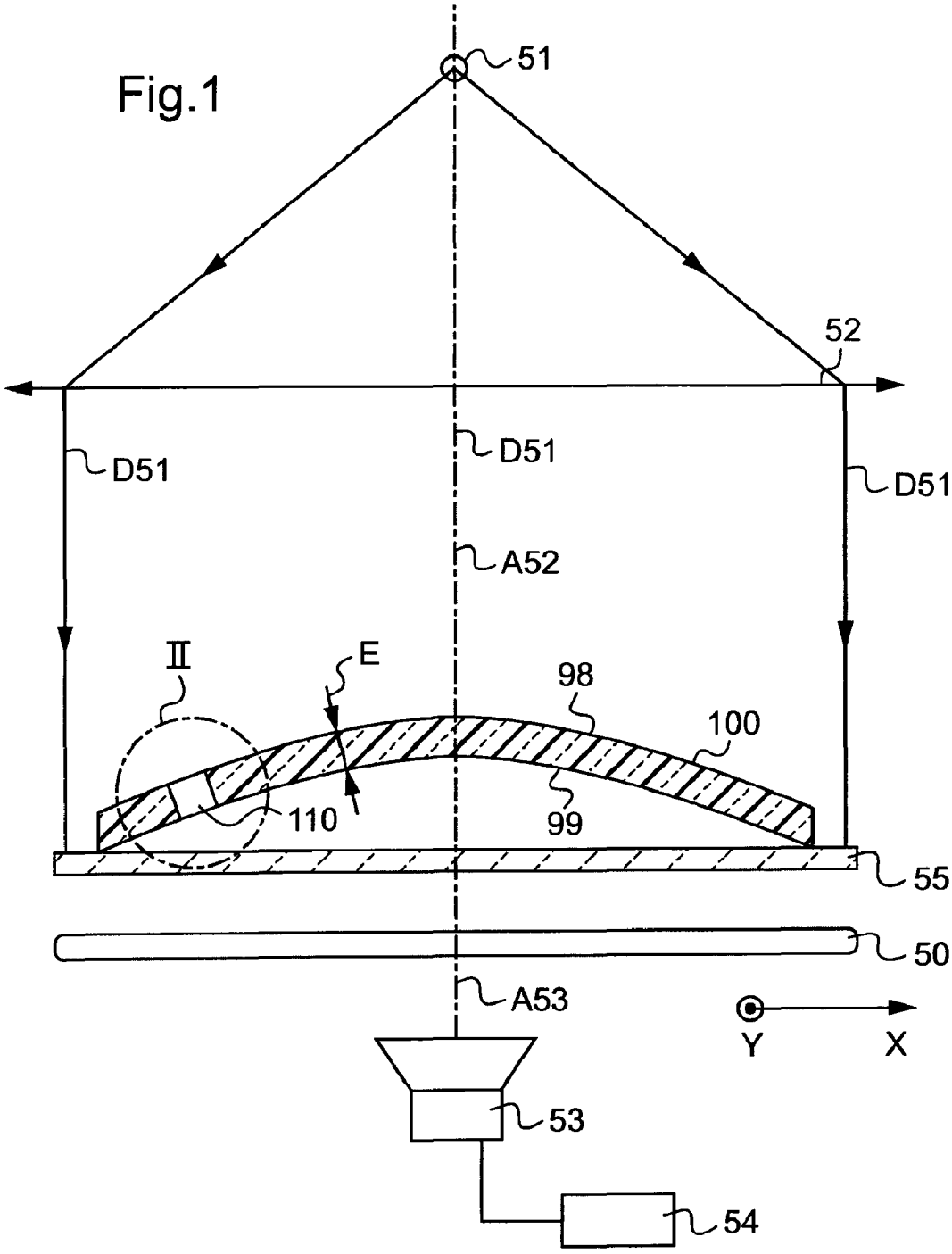
FIG. 1 is a diagrammatic view in axial section of an acquisition device for acquiring the position of the drill holes of a presentation lens in a first implementation of the invention.

FIG. 1 shows an acquisition device for acquiring the position of the drill holes of a presentation eyeglass lens. This acquisition device comprises lighting means 51, 52, a support 55 for the presentation lens 100 and image capture means 53.

The lighting means 51, 52 comprise a collimator lens 52 of axis A52 and a light source 51 placed at the focal point of the collimator lens 52. After passing through the collimator lens 52, the light rays are thus directed parallel to the axis A52 of the collimator lens 52. The lighting direction D51 is thus parallel to the direction of the axis A52.

The capture means 53 comprise a camera 53 provided with a lens having an optical axis A53. The device for acquiring the position of the reference drill holes comprises an optical axis defined as being the axis A52 of the collimator lens 52 and the axis A53 of the lens of the acquisition means 53. The direction of image capture by the acquisition means 53 here coincides with the lighting direction D51.

The support 55 of the presentation lens 100 is designed in such a manner that the presentation lens 100 extends in a plane that is transverse relative to the lighting direction D51. The lens 100 is thus lit from the front. The support 55 of the lens 100 is presented here in the form of a transparent disk made out of glass that is perpendicular to the lighting direction D51, so that neither the front face 98 nor the rear face 99 are hidden from sight by the support 55.

The presentation lens 100 presents two drill holes, a first drill hole 110 situated near to the temporal zone and another drill hole (not shown) situated near to the nasal zone of the lens. The description below gives details only about the reference drill hole 110, but the description also applies to acquiring the other drill hole. As shown in the top portion of FIG. 2, the drill hole 110 includes, firstly, an orifice 111 that opens into the front face 98 of the lens 100 and, secondly, an orifice 112 that opens into the rear face 99 of the lens 100. The center C2 of the drill hole 110 is also defined, being the mean position of the centers C1, C3 of the front 111 and rear 112 orifices.

The image capture means 53 are also linked to the image processor means 54. As explained below, the image processor means 54 are designed so as to deduce, from the acquired image, the position of center C1 of the orifice 111 of the drill hole 110 in the front face 98. Naturally, in a variant as explained below, the processor means 54 can also be designed to deduce, from the acquired image, the position of center of the orifice 112 of the drill hole 110 in the rear face 99.

In a main embodiment of the invention shown in the FIGS. 1 to 5, the acquisition device for acquiring the positions of drill holes is designed in such a manner that the camera 53 views the lens in projected view. In the main embodiment, the lighting means 51, 52 and the camera 53 are distributed on opposite sides of the lens support.

As shown in FIG. 1, the invention provides for a plate made out of frosted glass 50 to be disposed between the camera 53 and the lens support 55. The frosted glass plate 50 is centered on the axis A52 of the collimator lens 52 and extends along the plane transversal to the axis A52. The frosted glass plate 50 allows the shadow of the lens 100 to be formed and in particular the shadow of the drill hole 110 of the lens.

Figure 2:
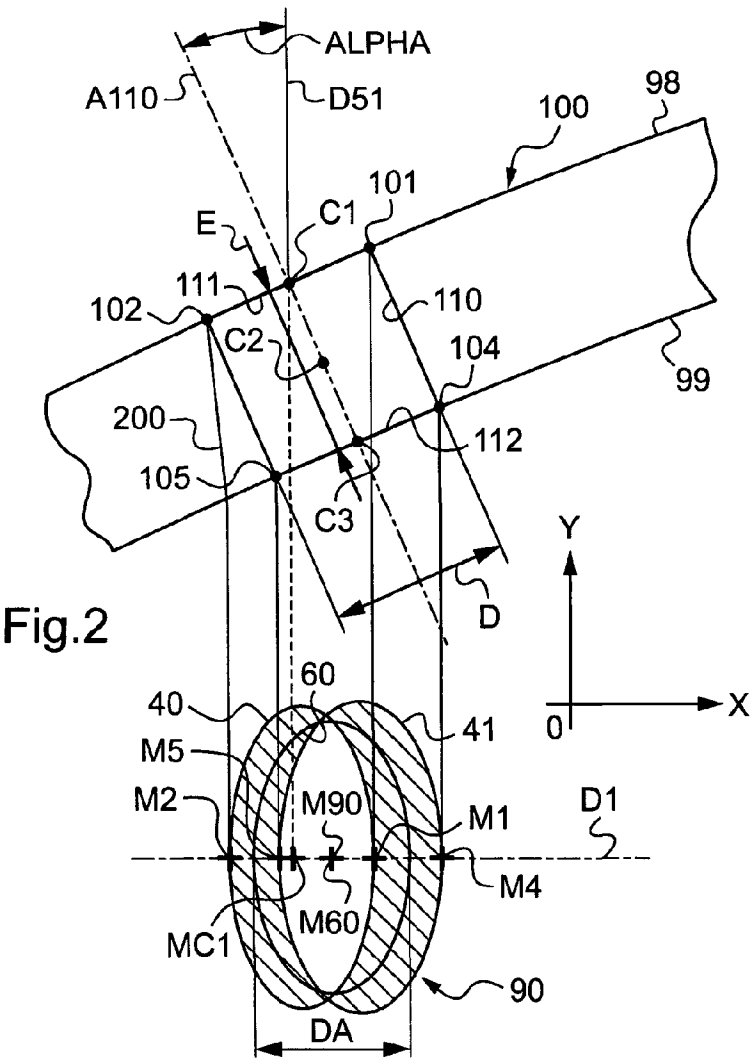
FIG. 2 is a combined view, with a top portion showing in axial section the drill hole of the presentation lens of FIG. 1 and a bottom portion showing, in a transverse plane, the overall image of the shadow of the drill hole projected onto the acquisition means, some of the points of the image being used for calculating the position of the drill hole in a first method.

The image of the shadow of the drill hole 110 of the lens is acquired by means of the acquisition device 53. The image shown in the bottom portion of FIG. 2 shows an overall image 90 of the drill hole.

The overall image 90 of the drill hole includes two rings 40, 41 of substantially oval shape that intersect each other. The first ring 40 is the projected shadow of the front face orifice 111 of the drill hole 110, and the second ring 41 is the projected shadow of the rear face orifice 112. The portion constituted by the superposition of the two rings 40, 41 is pale. This portion is the projection of a portion of the drill hole through which the light rays pass without touching the material of the lens. Conversely, the non-superposed portions of the two rings are dark as a result of the light rays being reflected or diffused by the side wall of the drill hole.

Several points in the overall image 90 of the drill hole 110 can be defined, as can the corresponding points of the drill hole in the lens.

The point 102 of the drill hole 110 results from the intersection between, firstly, a section plane of the lens containing an axis parallel to the lighting direction D51 and also the axis A110 of the drill hole 110 and, secondly, the portion of the outline of the orifice 111 in the front face of the lens that is situated towards the exterior of the lens. In addition, the point 101 is defined as being the point of intersection between the section plane of the lens and the portion of the outline of the orifice 111 in the front face 98 of the lens situated towards the interior of the lens. Points 105 and 104 are defined as being the points of intersection between the section plane of the lens with the portions of the orifice 112 in the rear face 99 of the reference lens that are situated respectively towards the exterior and towards the interior of the lens.

As shown in the bottom portion of FIG. 2, a straight line D1 is defined as the straight line passing through the center of the two rings 40, 41. This straight line D1 corresponds approximately to the trace on the screen 50 of the plane containing the axis A52 of the lens 100 and the center C2 of the hole 110.

The points M1 and M2 are the points of intersection between the straight line D1 and the right and left portions respectively of the ring 40 as shown In FIG. 2B. The points M1 and M2 are the image points of the points 101 and 102. Likewise, the points M4 and M5 are the points of intersection between the straight line D1 and the right and left portions respectively of the second ring 41 as shown in FIG. 2B. These points M4 and M5 are the image points of points 104 and 105. XM1, XM2, XM4, and XM5 mark the positions of points M1, M2, M4, and M5 on the straight line D1.

The point MC1 is the image point on the straight line D1 of the center C1, in projection in the image acquisition plane, for which the position XMC1 is to be calculated. Once the position XMC1 of the center C1 has been determined, its distance relative to a reference point on the edge of the lens is calculated.

In a first implementation of the main embodiment, shown in FIG. 2, the position XM90 of the center M90 of the overall image 90 of the drill hole is determined and the position of the center C1 of the orifice 111 in the front face 98 of the drill hole 110 is deduced therefrom.

The processor system 54 comprises a user interface and a display screen (not shown) that displays the overall image 90 of the drill hole 110.

The processor system 54 is also designed so as to enable an identification-marking ring 60 to be displayed on the screen. This ring presents dimensions that may be modified by the operator. The processor system 54 is also designed in such a manner that the identification-marking ring 60 can be moved around the display screen by the operator. The identification-marking ring 60 can be moved and its dimensions can be adjusted with the help of control tools integrated into the user interface of the processor system 54.

The operator sizes and centers the identification-marking ring 60 onto the overall image 90 of the reference drill hole 110. For centering the identification-marking ring 60 in the overall image 90, the operator may, e.g. as shown in FIG. 2, superpose the identification-marking ring 60 on the overall image 90 in such a manner that the identification-marking ring 60 passes through the middles of the segments M1, M4, and M2M5. The optician may alternatively make provision for adjusting the position and the dimensions of the identification-marking ring 60 so that it passes through the points M1 and M5 beside the pale portion of the overall image 90. The optician may also adjust the position and the dimension of the identification-marking ring 60 so as to make it pass through the points M2 and M4 beside the dark portion of the overall image 90

Once the ring is centered on the image of the shadow of the drill hole, the processor system 54 automatically detects and stores the position of the center M60 of the identification-marking ring 60. The position of the center M60 is associated with the position XM90 of the center M90 of the overall image 90 by the processor means 54.

In a variant, provision can be made for the operator to point on the screen, with a tool built into the user interface such as a mouse or a stylus, to the center M60 of the identification-marking ring 60, which position is then stored.

The processor system 54 calculates the position of center C1 of the orifice of the drill hole 110 opening into said face from the position of the center M90 of said overall image 90 and as a function of the angle of inclination ALPHA of the drill hole 110 and of the thickness E of the lens.

The angle of inclination ALPHA is the angle formed between the mean lighting direction D51 and the axis A110 of the drill hole. The angle ALPHA and the thickness E of the lens can be measured by feeling around the lens, for example, or by the operator inputting data manually with the help of an on-screen data input interface provided for this purpose. The lens thickness under consideration may be the local thickness of the lens around the drill hole or the mean thickness of the lens.

The position XMC1 of the center C1 is calculated as follows:

$$XMC1=XM90-E/2\cdot\sin(\mathrm{ALPHA}).$$

The processor system 54 thus associates said calculated position with the looked-for position of the center C1 of the orifice of the drill hole 110 opening into the front face 98 of the lens 100.

Naturally, if the looked-for position is the position XMC3 of the center C3 of the orifice in the rear face of the drill hole, the following relationship is used:

$$XMC3=XM90-E/2\cdot\sin(\mathrm{ALPHA}).$$

The way the value of the diameter D of the hole 110 is calculated depends on the method whereby the identification-marking ring 60 is superposed on the overall image 90 used.

When the identification-marking ring 60 is superposed on the overall image 90 in such a manner that the identification-marking ring 60 passes through the middles of the segments M1M4 and M2M5, the diameter D has a value of:

$$D=DA/\cos(\mathrm{ALPHA})$$

where DA is the diameter of the identification-marking ring 60.

When the position and the dimensions of the identification-marking ring 60 are adjusted so that it passes through the points M1 and M5 beside the pale portion of the overall image 90 then:

$$D=(DA+E\cdot\sin(\mathrm{ALPHA}))/\cos(\mathrm{ALPHA}).$$

When the position and the dimensions of the identification-marking ring 60 are adjusted so that it passes through the points M2 and M4 beside the dark portion of the overall image 90:

$$D=(DA-E\cdot\sin(\mathrm{ALPHA}))/\cos(\mathrm{ALPHA}).$$

In a variant of this first method of implementation, the center M60 of the identification-marking ring 60 is detected automatically by the processor system 54, which is thus designed to automatically superpose (with appropriate centering and sizing) the identification-marking ring 60 on the overall image 90 of the drill hole 110, and thus to determine the position and the diameter of the center M60 of the ring.

Figure 3:
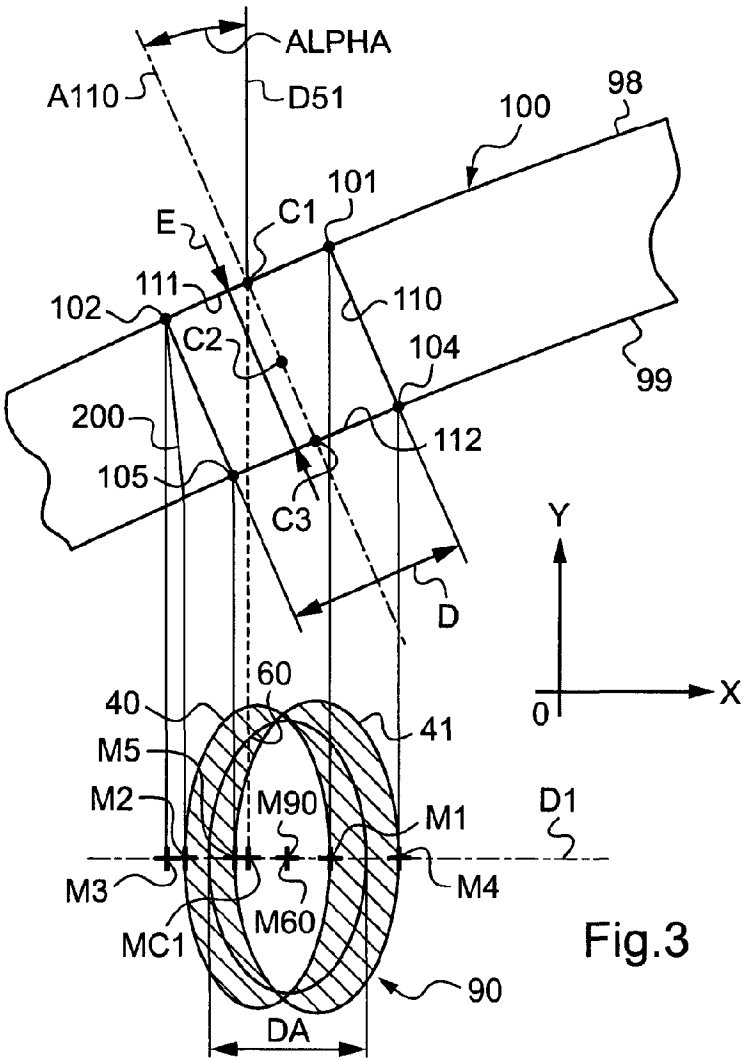
FIG. 3 is a combined view similar to FIG. 2 on which the position of an additional point has been added in order to calculate the position of the drill hole in a variant of the first method.

FIG. 3 shows a variant of the first method (shown in FIG. 2), with provision for improving the accuracy of the position XMC1 calculated for the projection MC1 of the center C1, when using the position XM90 of the center M90 of the overall image 90, by taking into consideration the prismatic deflections caused by the presentation lens 100 and therefore taking the refractive index of the lens into consideration. The refractive index of the presentation lens is thus different from 1, and here has a value of 1.5 for example.

When the identification-marking ring 60 is superposed on the overall image 90 in such a manner that the identification-marking ring 60 passes through the middles of the segments M1M4 and M2M5, (example shown in FIG. 3), the position of center C1 is given by the following equation:

$$XMC1=XM90-E\cdot(\sin(\mathrm{ALPHA}))/2-DC/4,\ \text{with}$$
$$DC=E\cdot\sin(\mathrm{ALPHA}-\arcsin((\sin(\mathrm{ALPHA}))/n))/\cos(\arcsin((\sin(\mathrm{ALPHA}))/n))).$$

Similarly, the accuracy with which the diameter D of the hole is calculated is improved by taking the refractive index of the lens into account. The way the diameter D of the hole 110 is calculated depends on the method whereby the identification-marking ring 60 is superposed on the overall image 90 used.

When the identification-marking ring 60 is superposed on the overall image 90 in such a manner that the identification-marking ring 60 passes through the middles of the segments M1M4 and M2M5, the diameter D has a value of:

$$D=(DA+DC/2)/\cos(\mathrm{ALPHA})$$

where DA is the diameter of the identification-marking ring 60 and where $$DC=E\cdot\sin(\mathrm{ALPHA}-\arcsin((\sin(\mathrm{ALPHA}))/n))/(\cos(\arcsin((\sin(\mathrm{ALPHA}))/n))).$$

Figure 4:
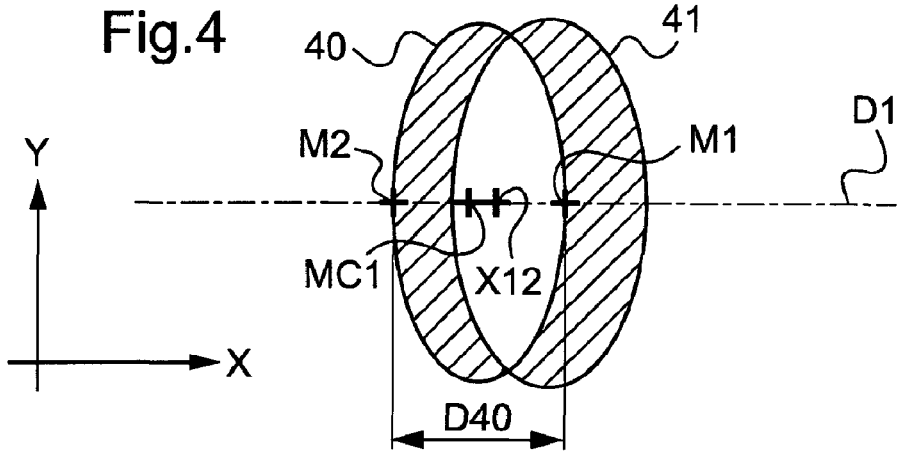
FIG. 4 is a view on a transverse plane similar to the bottom portion of FIGS. 2 and 3 of the projected overall image of the drill hole, showing the points useful for calculating the position of the centering hole in a second method.

In a second implementation of the main embodiment, shown in FIG. 4, the position of center of the overall image of the drill hole is not determined, but the positions of points M1 and M2 are acquired. The points M1, M2, as shown above, are points of intersection of the straight line D1 with the right and left portions of the ring 40.

The positions of the points M1 and M2 may be acquired by using a algorithm for automatically detecting the positions of the points. The algorithm may be designed in such a manner as to take, firstly, the position furthest to the left of the darkest point of the overall image 90 in order to obtain the position XM2 of the point M2 and, secondly, the position of the point furthest to the right of the pale portion of the overall image 90 in order to obtain the position XM1 of point M1. In a variant, provision can also be made for the overall image to be displayed on a screen and for the operator to point to the positions of the points M1 and M2 on the screen.

The center X12 of the segment M1, M2 is thus determined. The processor means 54 thus associate the position of center X12 of the segment M1, M2 with the position XMC1 of the center C1 of the orifice of the drill hole 110 opening into the front face. It should be understood that, in this example, the offset of the point M2 due to prismatic effects of the lens 110 is not taken into account, and this constitutes an approximation.

The corrected diameter D of the hole 110 is also calculated by means of the formula below:

$$D=D40/\cos(\text{ALPHA}),\ \text{with}$$

$$D40=abs(XM1-XM2)$$

the "abs" function returning the absolute value.

Figure 5:
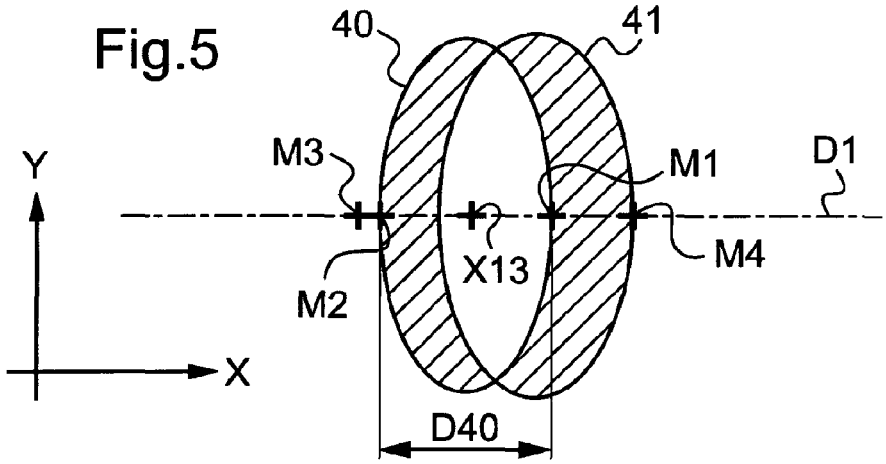
FIG. 5 is a view similar to FIG. 4, showing points useful for calculating the position of the centering hole in a variant of the second method.

FIG. 5 shows a variant embodiment of the second method (FIG. 4) with provision for improving the accuracy with which the position XMC1 of the center C1 is calculated, by using the positions of the points M1 and M2 in the overall image 90, and for improving the accuracy with which the diameter D of the hole 110 is calculated, by taking the refractive index of the presentation lens 100 into consideration. The refractive index n of the presentation lens is thus different from 1, and here has a value of n=1.5, for example.

The points M1, M4, and M5 are not offset when the points 101, 104, and 105 are projected onto the image acquisition plane, since the rays emerging from these points are not deflected by the presentation lens 100. Conversely, when a ray passes through the point 102, it then passes through the lens, and it is deflected by a certain amount, which depends on the angle ALPHA, on the refractive index of the lens, and on the mean thickness E of the lens. The ray reaches M2. Thus, as shown in FIG. 3, the projected distance on the straight line D1 between the point 102 and the point 105 is in reality equal to the distance between a point M3 and the point M5. The position of the point M3 corresponds to the theoretical position of the projection on the straight line D1 of the point along the optical axis of the optical device, without prismatic deflection by the presentation lens 100.

In this variant, it is assumed that, in projection on the straight line D1, the position X13 of the center of the segment defined by the two points M1, M3 corresponds to the corrected position of the center C1 of the orifice 111 of the drill hole 110, taking the prismatic deflections into consideration.

The distance DM2M3 between the points M2 and M3 is as follows:

$$DM2M3=E\cdot\sin(\text{ALPHA}-\arcsin((\sin(\text{ALPHA}))/n))/(\cos(\arcsin((\sin(\text{ALPHA}))/n))).$$

The position XM3 of M3 may thus be deduced from the acquired position XM2 of point M2 and from the calculated distance DM2M3.

The position XMC1 of the desired center C1 is thus obtained by the equation:

$$XMC1=(XM1+XM3)/2.$$

The diameter D of the hole 110 is also calculated by means of the following formula:

$$D=abs(XM1-XM3)/\cos(\text{ALPHA}).$$

In a variant, it is also easy to determine the position XMC3 of the projection MC3 of the center C3 of the orifice seen from the rear by means of the points M4 and M5 of the ring 41, which ring is not deflected by the lens. The position XMC1 of the projection MC1 of the center C1 and the corrected value of the diameter D of the hole 110 may thus be deduced by means of the following equations:

$$XMC1=XMC3-E\cdot\sin(\text{ALPHA})$$

$$D=abs(XM4-XM5)/\cos(\text{ALPHA}).$$

In another embodiment shown in FIGS. 6 and 7, the presentation lens 100 is viewed by the camera 53 in direct view. The camera 53 is arranged in such a manner that the optical axis of its camera lens is parallel with the lighting direction and that the optical center of its camera lens is situated at the focal point 51 of the collimator lens 52. A back-lighting assembly, composed of a matrix of light sources such as LEDs 56 and of a diffusion plate 57, is positioned near to the support plate 55 on its side opposite from the lens 100.

The camera 53 thus views the presentation lens 100 on the front face directly, i.e. without an intermediate projection screen.

As explained above, the camera lens acquires the image of the ophthalmic lens. The overall image of the drill hole acquired by the camera lens is shown diagrammatically in FIG. 7.

The ring 41, resulting from the projection of the rear orifice of the drill hole, is flattened as a result of the optical deflection of the light rays coming from the portions of the outline of the orifice in the rear face situated on the interior of the lens.

The various above-described embodiments (FIGS. 2 to 5) implemented for calculating the position of the orifice in the front or back face of the drill hole by using a projected view, can also be implemented in direct view by being adapted to the new arrangement of the points M1, M2, M4 and M5 as shown in FIG. 7.

More generally, the exact position XMC1 of the center of the orifice in the front face is easily obtained since there is no deflection of the light rays by the lens.

$$XMC1=(XM2+XM1)/2.$$

However, the diameter:

$$D41=abs(XM4-XM5)$$

of the ring 41 along the axis X is smaller than the diameter:

$$D40=abs(XM1-XM2)$$

because of the deformation due to the prismatic deflections generated by the lens. This deformation can be corrected in a manner analogous to that described above. However it is more convenient to measure the diameter D40 directly from the ring 40, and to apply the geometrical correction for projection using the angle ALPHA. The corrected diameter of the hole 110 is thus calculated as follows:

$$D=D40/\cos(\text{ALPHA}),\ \text{with}$$

$$D40=abs(XM1-XM2).$$

On the rear face, however the deflection of rays by the lens 110 must be taken into consideration. The position XMC3 of the center C3 of the orifice in the rear face is given by:

$$XMC3=(XM2+XM1)/2+abs(XM5-XM2).$$

In another embodiment (not shown), provision is made for further improving the accuracy of the calculation of the position of center of the orifice in the front face of the drill hole by taking into consideration at least one characteristic of the corrective lens to be drilled. This method of implementation may also be applied to the rear face.

The position of center of the orifice in the front face of the drill hole is calculated using one of the above-mentioned methods, in which the calculation of the position of the drill hole takes into consideration the angle ALPHA formed between the mean lighting direction D51 and the axis A110 of the drill hole.

An acquisition is also made of the angle formed between an axis of the corrective lens and the normal to the face of the corrective lens at the determined position for the hole to be drilled. Then the position of the hole to be drilled in the corrective lens is corrected as a function of the difference in value between said angle and the angle ALPHA between the mean lighting direction D51 and the axis A110 of the drill hole.

In the above-described methods of implementation in which provision is made to calculate the position XMC1 of the center of the orifice in the front face of the lens, it is possible to perform an operation, which consists not in calculating the distance in projection on the straight line D1 between the edge of the lens and the center C1, but consists rather in calculating the distance between the edge of the lens and the center of the hole along the surface of the lens. It is the determination of the distance along the surface of the lens that allows drilling to be performed correctly and therefore allows the lens to be mounted correctly on the frame.

The distance along the surface of the lens is measured, in known manner, by using the position of center of the orifice of the drill hole as determined by means of one of the methods of implementation described above, from the position XMB of the reference point of the edge of the lens in the image plane and using the value from the base of the lens.

To a first approximation, the distance along the surface DSURFC1 from the center C1 to the edge of the lens, is calculated as follows:

$$DSURFC1=abs(XMC1-XMB)/\cos(\mathrm{ALPHA})$$

with:

XMB being the position in projection on the straight line D1 of a reference point on the edge of the lens;

ALPHA=(R·B/(n−1)); and

R being the distance, projected onto the straight line D1, from the center C1 to the geometrical center of the outline of the lens (obtained by image processing), B being the base of the lens, and n being the refractive index of the lens.

The base of the lens may be entered manually by the operator with the help of an on-screen data input interface or obtained, for example, by a spherometer.

The angle ALPHA may also be calculated using positions XM1 and XM4 of the points M1 and M4 with the following equation, in the measuring configuration defined above in projected view (FIGS. 3 to 5):

$$\mathrm{ALPHA} = \arcsin(\mathrm{abs}(XM1 - XM4)/E)$$
$$= \arcsin(\mathrm{abs}(XM5 - XM3)/E).$$

For measuring in direct view (FIG. 7), the angle ALPHA is calculated in analogous manner using the equation:

$$\mathrm{ALPHA}=\arcsin(abs(XM5-XM2)/E).$$

The thickness E of the lens may be measured, for example, by feeling, or else it may be set to a mean value of about 2 millimeters.

The present invention is in no way limited to the methods of implementation described and shown, but a person skilled in the art can make other variants in accordance with the spirit of the invention.

Whatever the method of implementation described above, a variant implementation can be provided in which the orientation of the lens is inversed. It is thus the rear face of the lens that faces towards the lighting means 51, 52. The calculations are made similarly by taking into consideration the fact that the angle ALPHA is inverted. As a result, in projected view, on the overall image 90, it is no longer the point resulting from the projection of the point of the front orifice situated towards the outside of the lens that is deflected, but the point of the front orifice situated towards the inside of the lens. Likewise, in projected view, on the overall image 90, it is no longer the point resulting from the projection of the point of the front orifice situated towards the outside of the lens that is deflected, but the point of the front orifice situated towards the inside of the lens.

The invention claimed is:

1. A device for determining the position and/or a transverse dimension (D) of a drill hole (110) in a presentation lens (100) for rimless eyeglasses, the device comprising:

support means (55) for supporting the lens (100);

capture means (53) for capturing an overall image (90) of the drill hole (110) of the lens (100) in a lighting or image capture direction (D51, A52; A53); and processor means (54) for processing said image when the lens is carried by the support means (55);

the device being characterized in that the processor means (54) are suitable for determining, using said overall image (90) of the drill hole (110), the position of the center (C1) of the orifice of the drill hole (110) opening into one of the faces (98) of the lens (100) and/or the transverse dimension of said orifice of the drill hole (110) corresponding to the looked-for transverse dimension (D).

2. A device according to claim 1, wherein the processor means (54) comprise:

means for acquiring the position of center (M90) of the overall image (90) of the drill hole (110) and first correction means that are suitable for calculating the position of center (C1) of the orifice of the drill hole (110) in said face, using the position of said center (M90) of the overall image (90) and data representative of the angle of inclination (ALPHA) of the drill hole (110) formed between the lighting or image capture direction (D51, A52; A53) and the axis (A110) of the drill hole (110).

3. A device according to claim 2, wherein, for the overall image (90) comprising first and second image rings (40, 41) that are formed on the capture means (53) by the images of the orifices (111, 112) of the drill hole (110) and that are superposed in part, one upon the other, said acquisition means comprise:

means for generating an identification-marking ring (60);

means for superposing said identification-marking ring (60) onto the overall image (90);

means for storing the position of center (M60) of said identification-marking ring (60); and means for associating the stored position of center (M60) of said identification-marking ring (60) with the position of center (M90) of the overall image (90) of the drill hole (110).

4. A device according to claim 1, wherein the processor means (54) comprise:

means for acquiring the transverse dimension (DA) of the acquired overall image (90) of the drill hole (110); and first correction means that are suitable for calculating the transverse dimension (D) of the orifice of the drill hole (110) in said face, using the transverse dimension (DA) of the overall image (90) and data representative of the angle of inclination (ALPHA) of the drill hole (110) formed between the lighting or image capture direction (D51, A52; A53) and the axis (A110) of the drill hole (110).

5. A device according to claim 4, wherein, for the overall image (90) comprising first and second image rings (40, 41) that are formed on the capture means (53) by the images of the orifices (111, 112) of the drill hole (110) and that are superposed in part, one upon the other, said acquisition means comprise:

means for generating an identification-marking ring (60);

means for superposing and sizing said identification-marking ring (60) on the overall image (90);

means for storing the transverse dimension (DA) of said identification-marking ring (60); and means for associating the stored transverse dimension (DA) of said identification-marking ring (60) with the transverse dimension (DA) of the overall image (90) of the drill hole (110).

6. A device according to claim 2, wherein said first correction means also operate as a function of the refractive index ($\bar{n}$) and/or of the thickness (E) of the presentation lens (100).

7. A device according to claim 1, wherein, for the overall image (90) comprising first and second image rings (40, 41) that are formed on the capture means (53) by the images of the orifices (111, 112) of the drill hole (110) and that are superposed in part, one upon the other, the processor means (54) comprise:

means for acquiring the center (MC1) of the image ring (40) formed by the image of the orifice of the drill hole (110) opening into said face (98); and means for defining, with or without correction, the position of center (C1) of the orifice of the drill hole (110) opening into said face (98), as a function of the position of center (MC1) of said image ring (40).

8. A device according to claim 7, wherein said means for defining the position of the center (C1) of the orifice of the drill hole (110) opening into said face (98) calculate the first correction as a function of the refractive index ($\bar{n}$) and/or of the thickness (E) of the presentation lens (100).

9. A device according to claim 1, wherein, for the overall image (90) comprising first and second image rings (40, 41) that are formed on the capture means (53) by the images of the orifices (111, 112) of the drill hole (110), and that are superposed, one upon the other, the processor means (54) comprise:

means for acquiring the transverse dimension (D40) of the image ring (40) formed by the image of the orifice of the drill hole (110) opening into said face (98); and first correction means that are suitable for using the transverse dimension (D40) of said image ring (40) and data representative of the angle of inclination (ALPHA) of the drill hole (110) formed between the lighting or image capture direction (D51, A52; A53) and the axis (A110) of the drill hole (110) to calculate the transverse dimension (D) of the orifice of the drill hole (110) opening into said face.

10. A device according to claim 9, wherein said first correction means operate in addition as a function of the refractive index ($\bar{n}$) and/or of the thickness (E) of the presentation lens (100).

11. A device according to claim 1, wherein the processor means (54) are suitable for using the overall image (90) of the drill hole (110) to determine a relative distance in projection, between the center (C1) of the orifice of the drill hole (110) of the presentation lens (100) and the edge of the presentation lens (100), in projection along said lighting or image capture direction in an acquisition plane substantially perpendicular to said lighting or image capture direction.

12. A device according to claim 11, wherein the processor means (54) comprise second correction means that are suitable for using the relative distance in projection and data representative of the angle of inclination (ALPHA) of the drill hole (110) formed between the lighting or image capture direction (D51, A52; A53) and the axis (A110) of the drill hole (110), to calculate a real relative distance between the center (C1) of the orifice and the edge of the presentation lens (100), considered in the plane perpendicular to the axis (A110) of the drill hole (110).

13. A device according to claim 2, wherein the processor means (54) comprise:

means for acquiring the transverse dimension (DA) of the acquired overall image (90) of the drill hole (110); and first correction means that are suitable for calculating the transverse dimension (D) of the orifice of the drill hole (110) in said face, using the transverse dimension (DA) of the overall image (90) and data representative of the angle of inclination (ALPHA) of the drill hole (110) formed between the lighting or image capture direction (D51, A52; A53) and the axis (A110) of the drill hole (110).

14. A device according to claim 3, wherein said first correction means also operate as a function of the refractive index ($\bar{n}$) and/or of the thickness (E) of the presentation lens (100).

15. A device according to claim 4, wherein said first correction means also operate as a function of the refractive index ($\bar{n}$) and/or of the thickness (E) of the presentation lens (100).

16. A device according to claim 5, wherein said first correction means also operate as a function of the refractive index ($\bar{n}$) and/or of the thickness (E) of the presentation lens (100).

17. A device according to claim 7, wherein, for the overall image (90) comprising first and second image rings (40, 41) that are formed on the capture means (53) by the images of the orifices (111, 112) of the drill hole (110), and that are superposed, one upon the other, the processor means (54) comprise:

means for acquiring the transverse dimension (D40) of the image ring (40) formed by the image of the orifice of the drill hole (110) opening into said face (98); and first correction means that are suitable for using the transverse dimension (D40) of said image ring (40) and data representative of the angle of inclination (ALPHA) of the drill hole (110) formed between the lighting or image capture direction (D51, A52; A53) and the axis (A110) of the drill hole (110) to calculate the transverse dimension (D) of the orifice of the drill hole (110) opening into said face.

18. A device according to claim 8, wherein, for the overall image (90) comprising first and second image rings (40, 41) that are formed on the capture means (53) by the images of the orifices (111, 112) of the drill hole (110), and that are superposed, one upon the other, the processor means (54) comprise:

means for acquiring the transverse dimension (D40) of the image ring (40) formed by the image of the orifice of the drill hole (110) opening into said face (98); and first correction means that are suitable for using the transverse dimension (D40) of said image ring (40) and data representative of the angle of inclination (ALPHA) of the drill hole (110) formed between the lighting or image capture direction (D51, A52; A53) and the axis (A110) of the drill hole (110) to calculate the transverse dimension (D) of the orifice of the drill hole (110) opening into said face.

19. A device according to claim 2, wherein the processor means (54) are suitable for using the overall image (90) of the drill hole (110) to determine a relative distance in projection, between the center (C1) of the orifice of the drill hole (110) of the presentation lens (100) and the edge of the presentation lens (100), in projection along said lighting or image capture direction in an acquisition plane substantially perpendicular to said lighting or image capture direction.

* * * * *